United States Patent [19]

Yonezawa et al.

[11] Patent Number: 4,823,687

[45] Date of Patent: Apr. 25, 1989

[54] DIE-HEIGHT ADJUSTING DEVICE OF MECHANICAL PRESS

[75] Inventors: Keitaro Yonezawa, Amagasakishi; Yoshimitsu Tsutsui, Hatanoshi, both of Japan

[73] Assignee: Kabushiki Kaisha Kosmek and Amada Company, Limited, Japan

[21] Appl. No.: 129,757

[22] Filed: Dec. 4, 1987

[30] Foreign Application Priority Data

Dec. 4, 1986 [JP] Japan ..... 61-289814
Dec. 4, 1986 [JP] Japan ..... 61-289815

[51] Int. Cl.[4] ..... B30B 1/06

[52] U.S. Cl. ..... 100/53; 74/44; 74/583; 74/586; 100/257

[58] Field of Search ..... 100/257, 918, 269 R, 100/282, 35, 98 R, 215, 218, 232, 249, 265; 411/83, 931; 74/44, 586, 581, 583, 584

[56] References Cited

U.S. PATENT DOCUMENTS

| | | | |
|---|---|---|---|
| 3,892,143 | 7/1975 | Kleister et al. | 100/257 X |
| 4,033,252 | 7/1977 | Baker | 100/257 X |
| 4,150,618 | 4/1979 | Spanke et al. | 100/257 |
| 4,575,392 | 3/1986 | Julliard et al. | 100/35 |
| 4,676,090 | 6/1987 | Nishimura et al. | 100/257 X |

FOREIGN PATENT DOCUMENTS

| | | | |
|---|---|---|---|
| 1214482 | 6/1984 | Japan | 100/257 |

*Primary Examiner*—Timothy F. Simone

*Attorney, Agent, or Firm*—Lowe, Price, Leblanc, Becker & Shur

[57] ABSTRACT

In a die-height adjusting device of a mechanical press, a slide of the mechanical press is interlockingly connected to a prime mover through a slide actuating mechanism, and an extendible and contractible device for the adjustment of the die-height is provided at the part between the output end portion of the slide and the slide actuating mechanism supported by a frame. The extendible and contractible device is adapted to be adjusted and stopped in the extending and contracting direction thereof by an operating device for the extension and contraction adjustment. Said extendible and contractible device for the adjustment of the die-height comprises an extending and contracting mechanism and a clamp. Said operating device for the extension and contraction adjustment comprises an actuating means for the extending and contracting mechanism and a clamp actuating means. The extending and contracting mechanism is adapted to be actuated extendibly and contractibly by the actuating means for the extending and contracting mechanism. The clamp is adapted to be actuated by the clamp actuating means so as to serve the clamping. And a driven member of the extending and contracting mechanism is adapted to be fixed to a driving member thereof by the clamp so as to prevent a relative loose movement therebetween in the extending and contracting direction in a state in which the clamp is actuated to the clamping position by the clamp actuating means.

12 Claims, 7 Drawing Sheets

DIE-HEIGHT ADJUSTING DEVICE OF MECHANICAL PRESS

BACKGROUND OF THE INVENTION

1. Field of the Invention

The present invention relates to a die-height adjusting device of mechanical press such as a crank press and a knuckle joint press, etc.

As for a basic construction of such a die-height adjusting device has so far been generally known the following one.

That is, a slide of a mechanical press is interlockingly connected to a prime mover through a slide actuating mechanism. At the part of the press between the slide actuating means supported by a frame and an output end portion of the slide, there is provided an extendible and contractible device for the adjustment of the die-height, which is adapted to be adjustably actuated and stopped in the extending and contracting direction thereof by means of an operating device for the extension and the contraction adjustment thereof.

As known well in the art, at each coupling portion in this basic construction, there is provided a clearance for a movement thereof, which may be gathered so as to form a total clearance. During a punching operation of the mechanical press, the frame of the press is resiliently deformed by a reaction force which is generated when a punch performs a punching for a work plate, and the slide is struck out abruptly by a restorative resilient force of the frame through the slide actuating mechanism at the time of breakthrough thereof just afer the punching is performed. At that time, a collision is caused at the every portion forming the total clearance so as to cause noises of shock, abrasions and deformations.

The concrete construction of the die-height adjusting device which is known by the inventor of the present invention will be described with reference to FIGS. 7 and 8 hereinafter.

In FIGS. 7 and 8, the symbol 204 is a slide, 208 is a slide actuating mechanism, and 218 is an extendible and contractible device for the adjustment of the die-height. And in the intermediate portion of a connecting rod 224, there is provided a height-adjusting screw means 280 which comprises a female screw 281 provided in a big end portion 225 of the connecting rod 224 and a male screw 282 provided on the small end portion 226 thereof so as to be threadably mounted to the female screw 281.

The conventional basic construction functions as follows.

When a die-height adjustment is required, the die-height is adjusted by the upward and downward movement of the slide 204 in the height direction which is controlled by the length adjustment of the connecting rod 224 carried out by rotating the small end portion 226 through a gearing mechanism 283 by an electric motor 241 for the height adjustment, which constitutes an extendible and contractible device 219 for the adjustment of the die-height. On the other hand, during the work of press, the force of press is transmitted to the slide 204 through the height-adjusting screw means 280 and the small end portion 226 of the connecting rod from the big end portion 225 of the connecting rod so that the punching is carried out for the work plate by a die-set one of which is detachably fixed to the output end portion 217 of the slide 204.

Even though the above-mentioned prior art has an advantage that the die-height can be adjusted readily, there are, however, the following disadvantages associated therewith.

(1) Noises made by the mechanical press is very large.

As shown in FIG. 8, in order to rotate the small end portion 226 smoothly by the electric motor 241 for the height adjustment, it is necessary to provide a clearance (e) for a screw engagement between the female screw 281 and the male screw 282. And since the height-adjusting screw means 280 is enlarged in their diameters in order to transmit a force of press, the clearance (e) for the screw engagement also gets enlarged.

Moreover, since the die-height adjustment is carried out in the cold condition of the mechanical press before its operation and the press is expanded in the hot condition thereof at the normal operation of the punching process, the clearance (e) gets further enlarged.

The large clearance (e) for the screw engagement makes the above-mentioned total clearance larger in the slide actuating mechanism 208. As the result, the enlarged total clearance tends to make shock noises, abrasions and deformations larger at the time of breakthrough.

(2) The electric motor for the height adjustment becomes large.

Since the height-adjusting screw means 280 of a large diameter is required for the transmission of the force of press, a friction resistance gets large at the operation of the press and the transmission efficiency gets lowered. Therefore, it becomes necessary to mount a large electric motor 241 for the height adjustment and an energy loss gets also increased.

In the case that a pre-load is applied by the electric motor 241 when the die-set is mounted onto the mechanical press, a larger electric motor 241 is required in compensation for the low transmission efficiency of the height-adjusting screw means 280 and an energy loss also gets more increased.

SUMMARY OF THE INVENTION

An object of the present invention is to prevent the occurrence of a loose clearance in an extendible and contractible device for the adjustment of the die-height so as to alleviate shock noises, abrasions and deformations.

Another object of the present invention is to provide a die-height adjusting device which can be operated by a small-sized operating device for an extension and contraction adjustment.

For accomplishing the above-mentioned objects, the present invention is constructed by the provision of the following improvements for the above-mentioned basic construction.

That is, the extendible and contractible device for the adjustment of the die-height comprises an extending and contracting mechanism and a clamp, the operating device for the extension and contraction adjustment comprises an actuating means for the extending and contracting mechanism and a clamp actuating means, the extending and contracting mechanism is adapted to be actuated extendibly and contractibly by the actuating means for the extending and contracting mechanism, the clamp is adapted to be actuated by the clamp actuating means so as to serve the clamping, and a driven member of the extending and contracting mechanism is adapted to be fixed to a driving member thereof by the clamp so as to prevent a relative loose movement therebetween in the extending and contracting direction in a state in which the clamp is actuated to the clamping position by the clamp actuating means.

Since the present invention is constructed as noted above, it functions as follows.

When the die-height is adjusted, first of all the clamp is actuated by the clamp actuating means so as to serve the clamping. Then, the extending and contracting mechanism is actuated by the actuating means for the extending and contracting mechanism so as to shift the slide in the height direction thereof and adjust the die-height. And by actuating the clamp to the clamping position by the clamp actuating means, the driven member of the extending and contracting mechanism is fixed to the driving member thereof through the clamp. Accordingly, a loose clearance is completely removed from the extending and contracting mechanism after the completion of the die-height adjustment and the total clearance in the slide actuating mechanism is lessened. As the result, it becomes possible to restrain the generations of shock noises, abrasions and deformations caused by the breakthrough at the time of the punching work considerably.

The foregoing and other objects and attendant advantages of the present invention will be readily appreciated as the same becomes better understood by reference to the following detailed description when considered by the accompanying drawings, wherein:

BRIEF DESCRIPTION OF THE DRAWINGS

FIGS. 1 and 2 show the first embodiment;

FIG. 1 is a vertical sectional view showing the enlarged principal part shown in FIG. 2;

FIG. 2 is a partial sectional view showing one side of the mechanical press;

FIG. 3 is a view showing a variant example of the first embodiment in correspondence with FIG. 1;

FIG. 4 is a view showing another variant example of the first embodiment in correspondence with FIG. 1;

FIG. 5 is a view showing the second embodiment in correspondence with FIG. 1;

FIG. 6 is a partial view showing a variant example of the second embodiment in correspondence with FIG. 5;

FIG. 7 is a partial sectional view showing the principal part of a mechanical press; and FIG. 8 is an enlarged sectional view of a height-adjusting screw means.

DESCRIPTION OF THE PREFERRED EMBODIMENTS

Now the embodiments of the present invention will be described with reference to the drawings hereinafter.

<First Embodiment >

Figure 1:
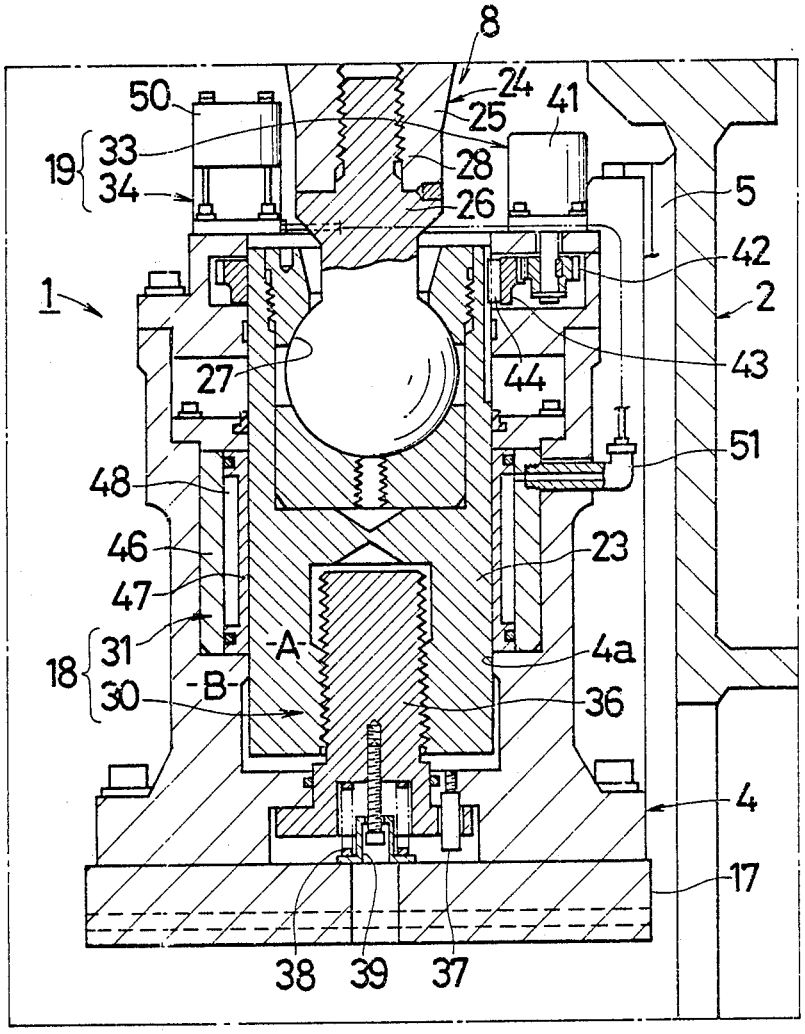
FIGS. 1 through 6 show the embodiments of the present invention.
Figure 2:
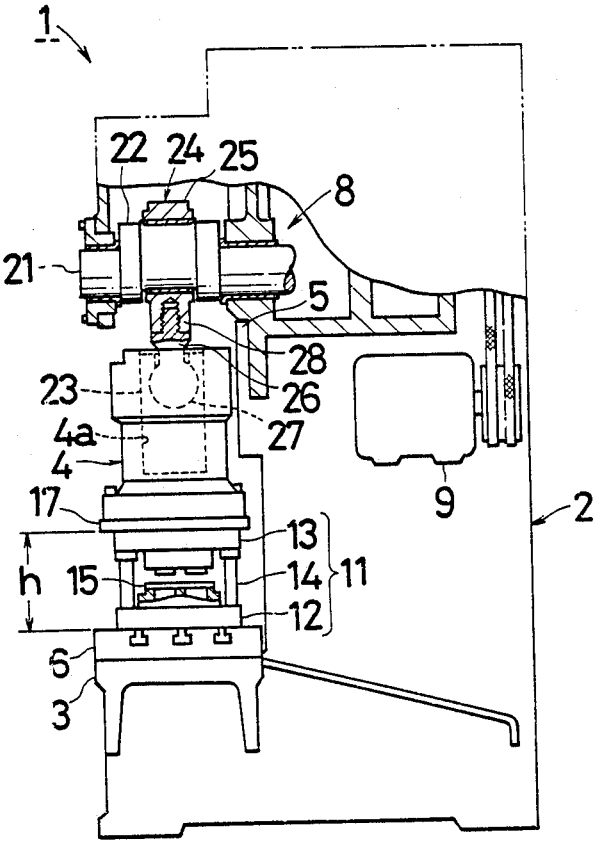

FIGS. 1 and 2 show the first embodiment.

In FIG. 2, the symbol 1 is a crank press (a mechanical press) which has a C-shaped frame 2. A slide 4 is supported by the frame 2 through a slide guide 5 so as to be slidable upwardly and downwardly relative to a bed 3 provided at the front side of the crank press 1. A bolster 6 is fixedly secured on the bed 3.

The slide 4 is interlockingly connected to a main electric motor 9 as a prime mover through a slide actuating mechanism 8 so as to be actuated in the upward and downward direction thereof. The symbol 11 is a die-set for a punching work, which die-set comprises a lower die 12 and an upper die 13 which is movable relative to the lower die 12 under the guidance of guide posts 14. The lower die 12 is fixedly secured onto the bolster 6, and the upper die 3 is fixedly secured to an adapter plate (an output end portion) 17 of the slide 4. The symbol 15 is a work plate to be punched.

A die-height (h) is adjusted in correspondence to a height dimension of the die-set 11. That is, as shown in FIG. 1, between the adapter plate 17 of the slide 4 and the slide actuating mechanism 8 supported by the frame 2, there is provided an extendible and contractible device 18 for the adjustment of the die-height, which is adapted to be adjusted and stopped in the extending and contracting direction by an operating device 19 for the extension/contraction adjustment.

First of all, the slide actuating mechanism 8 will be explained hereinafter. A crank shaft 21 is supported rotatably at the upper portion of the frame 2 and has a crank 22 formed at the foreside thereof. The slide 4 has a cylindrical bore **4*a* formed extendedly therewithin in the upward and downward direction thereof, in which a piston 23 is fitted slidably. Between the crank 22 and the piston 23, there is provided a connecting rod 24, of which big end portion 25 is coupled to the crank 22 and of which small end portion 26 is coupled to the upper portion of the piston 23 through a ball joint 27. The big end portion 25 of the connecting rod 24 is detachably connected to the small end portion 26 thereof by a screw means 28**.

Then, the extendible and contractible device 18 for the adjustment of the die-height and the operating device 19 for the extension and contraction adjustment will be explained hereinafter. The extendible and contractible device 18 for the adjustment of the die-height comprises an extending and contracting mechanism 30 and a clamp 31. The operating device 19 for the extension and contraction adjustment comprises an actuating means 33 for the extending and contracting mechanism and a clamp actuating means 34. The extending and contracting mechanism 30 is adapted to be actuated extendibly and contractibly by the actuating means 33 for the extending and contracting mechanism, and the clamp 31 is adapted to be actuated by the clamp actuating means 34 so as to serve the clamping.

The extending and contracting mechanism 30 is provided with a height-adjusting screw means 36 threadably mounted to the lower portion of the piston 23. The height-adjusting screw means 36 is supported at its lower portion by the lower portion of the slide 4 at a state in which its rotation is prevented by a linear movement guide 37, and is elastically forced to the slide 4 by a compression spring 38. The symbol 39 is a spring holder. When the piston 23 is rotated about the axis of the connecting rod 24 through the ball joint 27, the height-adjusting screw means 36 is moved upwardly and downwardly relative to the piston 23 and then the slide is actuated upwardly and downwardly through the height-adjusting screw means 36.

The piston 23 is adapted to be driven rotatively by the electric motor 41 for the height adjustment as the actuating means 33 for the extending and the contracting mechanism. That is, a driving gear 42 is fixed to the output shaft of the electric motor 41, and a driven ring gear 43 is mounted onto the periphery of the upper portion of the piston 23 through a linear movement guide 44 so to be relatively movable vertically. The driven gear 43 is supported freely rotatably within the upper portion of the slide 4 and meshed with the driving gear 42. Accordingly, the piston 23 is adapted to be rotated by the height-adjusting electric motor 41 through the driving gear 42 and the driven gear 43 so as to move the slide 4 along a slide guide 5 through the height-adjusting screw means 36.

The clamp 31 is provided with a cylinder 46 fixedly secured to the intermediate portion of the interior of the slide 4. And there is provided a friction engaging sleeve 47 between the peripheral interior surface of the cylinder 46 and the peripheral exterior surface of the piston 23. The upper and lower opposite ends of the friction engaging sleeve 47 are fixedly fitted in an oil-tight manner into the peripheral interior surface of the cylinder 46. And a clamp actuating oil chamber 48 is provided between the cylinder 46 and the friction engaging sleeve 47. The peripheral interior surface of the sleeve 47 is in contact with the peripheral exterior surface of the piston 23 vertically slidably.

When the clamp actuating oil chamber 48 is supplied with a pressure oil through a oil supply conduit 51 from a booster pump 50 of the clamp actuating means 34, the peripheral interior surface of the friction engaging sleeve 47 is engaged by a pressure with the peripheral exterior surface of the piston 23 so that the piston 23 is a driving member A is frictionally secured to the slide 4 as a driven member B by a predetermined clamp force. During the press work, even though the reaction force generated by the pressing acts on the slide 4, the slide 4 is kept frictionally secured strongly to the piston 23 by the friction securing force as the clamp force. Therefore, the press force is transmitted surely to the slide 4 and a slippage of the slide 4 by a press reaction force is prevented so that the manufacturing accuracy is improved in the crank press 1.

By the way, the above-mentioned clamp 31 may be applied to an overload safety device. In this case, a clamp force of the clamp 31 is settled to the nearly same value as the full load of the crank press. When an overload is applied to the slide 4 at the press work, it becomes impossible for the friction securing force to prevent a slippage between the friction engaging sleeve 47 and the piston 23 and the connecting rod 24 is allowed to move downwardly while the downward movement of the slide 4 is blocked due to the overload. Accordingly, a safety operation is secured even though an overload happens to be applied to the press.

In this first embodiment, the crank press 1 may be replaced with a knuckle joint press as the mechanical press. Further, since the extendible and contractible device 18 for the adjustment of the die-height should be provided at the part between the output end portion 17 of the slide 4 and the slide actuating mechanism 8 supported by the frame 2, it may be provided within the connecting rod 24, for example.

Figure 3:
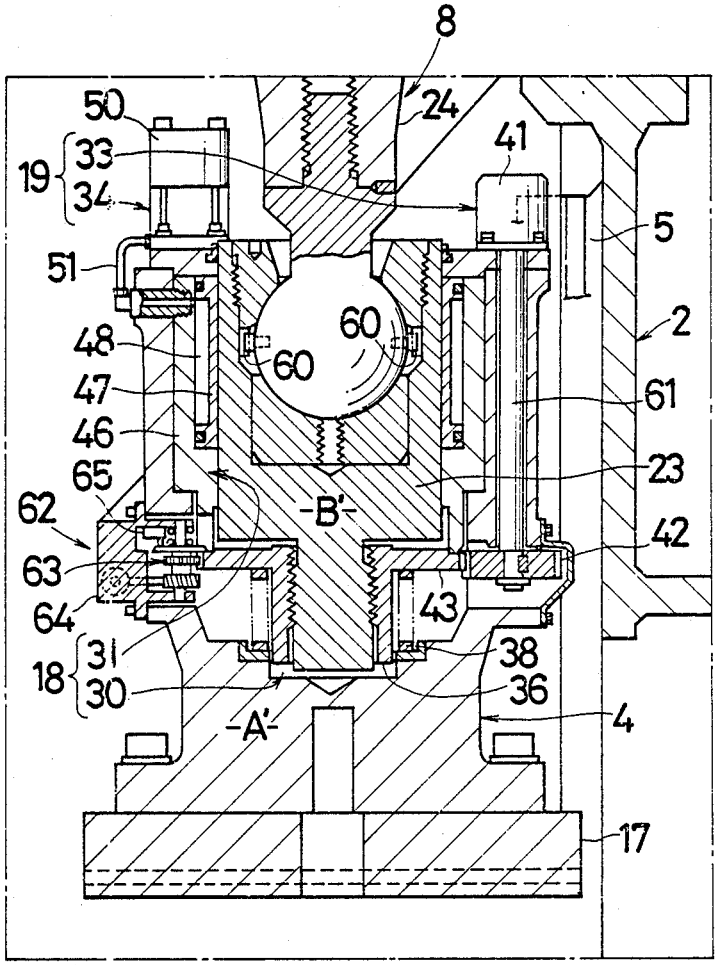
Figure 4:
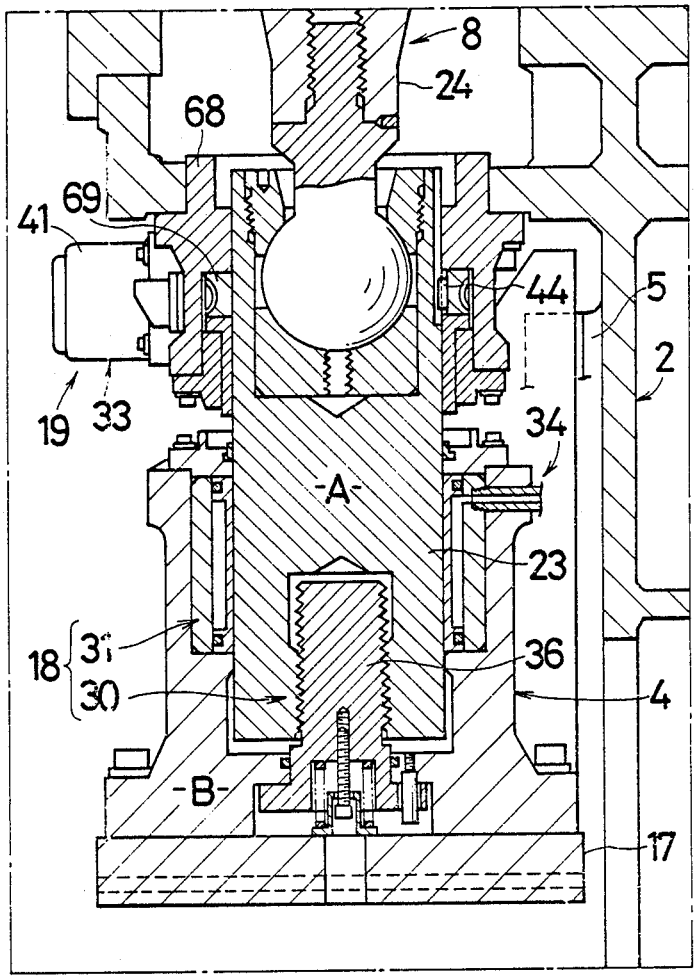

FIGS. 3 and 4 show a variant example of the first embodiment respectively. The parts having the same function as those in the first embodiment are indicated by the same symbol respectively.

The variant example shown in FIG. 3 is constructed as follows.

In this example, a driving member A' comprises a slide 4, and a driven member B' comprises a piston 23. That is, the piston 23 is mounted to a connecting rod 24 so that a relative turning therebetween is prevented by stopper pins 60. A height-adjusting screw means 36 is formed in a cylindrical configuration. The female screw thereof is threadably mounted to the male screw of the lower portion of the piston 23. A driven gear 43 is provided around the periphery of the upper portion of the height-adjusting means 36, and the upper surface of the driven gear 43 is elastically forced toward the underside of the cylinder 46 by a compression spring 38 so as to be freely rotatable relatively. The driven gear 43 is meshed with a driving gear 42 which is fixedly mounted onto a lower end portion of an output shaft 61 of a height-adjusting electric motor 41.

When the die-height is adjusted, the height-adjusting electric motor 41 is operated so that the height-adjusting screw means 36 is moved upwardly and downwardly through both the driving gear 42 and the driven gear 43 and then the slide 4 is moved upwardly and downwardly by the screw means 36.

By the way, the symbol 62 is a die-height indicating means which comprises a transmission gearing 63 to be driven by the driven gear 43 and a counter 64 for a die-height indication. The symbol 65 is a microswitch (a limit switch) which serves to detect the overload safety operation described in the first embodiment.

The variant example shown in FIG. 4 is constructed as follows.

An upper portion of a piston 23 is supported vertically slidably by a frame 2 through a piston guide 68. A worm wheel 69 is mounted vertically movably to the peripheral exterior surface of the piston 23 through a linear guide 44 in the piston guide 68. At the side of the piston guide 68, there is provided a height-adjusting electric motor 41 which serves to rotate the worm wheel 69 through a worm fixedly secured onto the output shaft thereof. According to this construction, the height-adjusting electric motor 41 hardly breaks down because it is not adversely affected by shocks at the press work.

According to the above-mentioned construction, the present invention functions as follows at the time of the die-height adjustment.

First of all, the friction engaging sleeve 47 of the clamp 31 is actuated by the operation of the booster pump 50 of the clamp actuating means 34. Then the slide 4 is moved upwardly and downwardly in the height direction thereof by the extension and the contraction of the extending and contracting mechanism 30 actuated by the operation of the height-adjusting electric motor 41 of the actuating means 33 for the mechanism 30 so that the die-height (h) is adjusted. And by the clamping function of the friction engaging sleeve 47 as mentioned above, the slide 4 as the driven member B is frictionally fixed to the piston 23 as the driving member A of the extending and contracting mechanism 30. Therefore, after the adjustment of the die-height (h), the loose clearance in the extending and contracting mechanism 30 is made ineffective and the total clearance in the slide actuating mechanism 8 becomes lessened. As the result, the generations of shock noises, abrasions and deformations are remarkably restrained at the time of breakthrough during the punching work.

Accordingly, the following advantages can be attained.

(1) After the adjustment of the die-height (h), the total clearance in the slide actuating mechanism 8 can be lessened by combining the driving member A and the driven member B in the extending and contracting mechanism 30 through the clamp 31 so as to override the loose clearance therebetween. Consequently, the generations of shock noises, abrasions and deformations can be restrained remarkably at the punching work.

(2) Since the extending and contracting mechanism 30 only functions to extend and contract the driven member B relative to the driving member A but doesn't transmit the press force, the friction resistance thereof can be lessened and the transmission efficiency for the height-adjusting force can be enhanced. Therefore, the actuating means 33 for the extending and contracting mechanism 30 can be made in a small size and in a small capability so as to consume less energy. Also in the case that a pre-load is applied to the die-set 11 by the actuating means 33 for the extending and contracting mechanism 30 when the die-set is mounted to the crank press 1, the actuating means 33 can be made in a small size and in a small capability so as to consume less energy owing to the high transmission efficiency of the extending and contracting mechanism 30.

<Second Embodiment >

Figure 5:
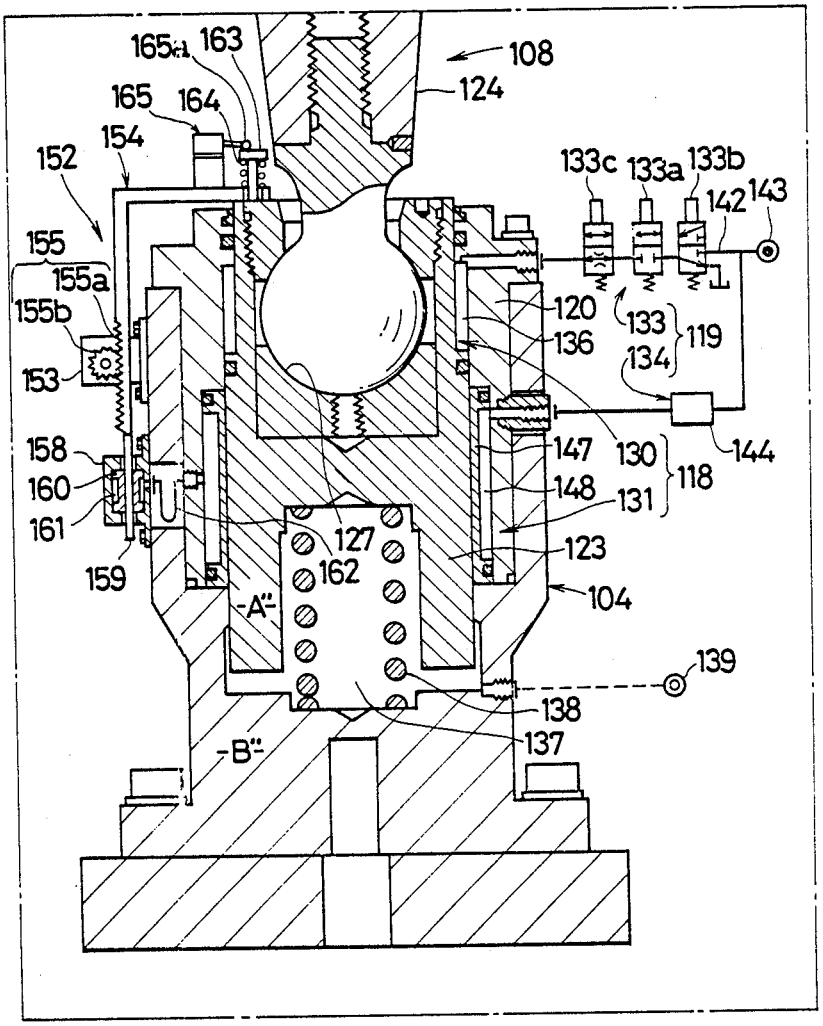

FIG. 5 shows the second embodiment. A construction different from the above-mentioned one will be explained hereinafter.

In this embodiment, the extendible and contractible device 118 for the adjustment of the die-height comprises an extending and contracting mechanism 130 of the oil pressure actuating type and an oil pressure type clamp 131. An operating device 119 for the adjustment of the extension and contraction comprises a pressure oil supply exhaust means 133 for the actuation of the extending and contracting mechanism and a pressure oil supply exhaust means 134 for the clamp actuation. The extending and contracting mechanism 130 of the oil pressure actuating type is adapted to be actuated adjustably under the control of the pressure oil supply by the pressure oil supply exhaust means 133 for the actuation of the extending and contracting mechanism. The oil pressure type clamp 131 is adapted to be actuated under the control of the pressure oil supply by the pressure oil supply exhaust means 134 for the clamp actuation. And under the actuated condition of the oil pressure type clamp 131 by he pressure oil supply exhaust means 134, the clamp 131 functions to fix the driven member B" to the driving memeber A" of the extending and contracting mechanism 130 of the oil pressure actuation type so as not to allow a loose movement thereof in the extension and contraction direction.

The extending and contracting mechanism 130 of the oil pressure actuation type has an actuating oil chamber 136 for the height-adjustment which is provided between the interior peripheral surface of a cylinder 120 in a slide and the exterior peripheral surface of the piston 123. By the way, at the under side of the piston 123, there is provided a spring chamber 137 in which a return spring 138 is mounted and which also functions as an air spring introduced thereinto from a pressurized air source 139. When the actuating oil chamber 136 is supplied with a pressure oil, the slide 104 is moved upwardly against the resilient force of the return spring 138 and the air spring. On the other hand, when the pressure oil is exhausted from the actuating oil chamber 136, the slide 104 is moved downwardly by the resilient force of the return spring 138 and the air spring.

The supply and exhaust of the pressure oil in the actuating oil chamber 136 is controlled by the pressure oil supply exhaust means 133 for the actuation of the extending and contracting mechanism, which is provided with an open/close valve 133*a*, a supply/exhaust valve 133*b* and a speed changeover valve 133*c* arranged in order in series communication, which are connected to a pressure oil source 143 through a supply/exhaust conduit 142. The supply and exhaust of the pressure oil for th actuating oil chamber 136 is controlled by the supply/exhaust valve 133*b*. A supply/exhaust quantity of the pressure oil is adapted to be changed over by the speed changeover valve 133*c* so as to change an extending and contracting speed of the slide 104, that is an adjusting speed of the die-height (h).

The oil pressure type clamp 131 is constructed as follows.

That is, between the interior peripheral surface of the cylinder 120 and the exterior peripheral surface of the piston 123 at the lower half portion of the cylinder 120, there is provided a friction engaging sleeve 147, of which opposite end portions are fitted into the cylinder 120 in an oil-tight manner. And between the cylinder 120 and the friction engaging sleeve 147, there is provided a clamp actuating oil chamber 148. The interior peripheral surface of the friction engaging sleeve 147 is in contact with the exterior peripheral surface of the piston 123 vertically slidably.

The pressure oil supply exhaust means 134 for the clamp actuation is provided with a supply/exhaust valve unit 144, which comprises the same valves as the above-mentioned ones 133*a* through 133*c*.

When the pressure oil is supplied into the clamp actuating oil chamber 148 through the supply/exhaust valve unit 144, the friction engaging sleeve 147 gets engaged in contact with the exterior peripheral surface of the piston 123 so that the piston as the driving member A" is frictionally fixed to the slide 104 as the driven member B" by a predetermined clamp force. During the press work, even though a press reaction force acts on the slide 104, the press force is transmitted surely to the slide 104 because the slide 104 is frictionally fixed to the piston 123 strongly by the frictional engaging force.

The symbol 152 is a die-height indicating means which comprises a counter 153 for indicating the die-height and a transmission rod 154. The counter 153 is attached to the slide 104, and the transmission rod 154 is connected to the upper part of the piston 123. When the slide 104 is moved extendedly and contractedly relative to the piston 123, the counter 153 is adapted to be driven by a gearing 155 comprising a rack 155*a* and a pinion 155*b*.

In the case of the provision of an overload safety device for the crank press, the die-height indicating means 152 is constructed as follows. That is, a cylinder 158 is fixedly secured to the slide 104 at the under side of the counter 153, And there is provided an actuating rod 159 protruded downwardly from the transmission rod 154 so as to pass through the cylinder 158 vertically movably. Between the cylinder 158 and the actuating rod 159, there is provided a friction engaging sleeve 160 constructed nearly the same as that 147 of the oil pressure type clamp 131. The symbol 161 is an actuating oil chamber which is connected in communication to the clamp actuating oil chamber 148 through a pressure oil hose 162.

Further, on the upper face of the piston 123, there is provided a coupling rod 163 protruded upwardly to which the transmission rod 154 is coupled vertically movably and is pressed downwardly elastically by a coupling spring 164. And a microswitch 165 is attached to the upper side of the transmission rod 154 so that a contact piece 165a thereof can abut onto the upper side of the coupling rod 163.

At the time of the die-height adjustment, when the pressure in the actuating oil chamber 161 is reduced through the supply/exhaust valve unit 144, the actuating rod 159 is allowed to move vertically with respect to the friction engaging sleeve 160. And then when the slide 104 is actuated extendedly and contractedly, the counter 154 for the dieheight indication is driven through the gearing 155 by the transmission rod 154 which is moved synchronously with the slide 104. On the other hand, during the press work, the pressure oil is supplied to the actuating oil chamber 161 so that the friction engaging sleeve 160 is engaged under a pressure with the periphery of the actuating rod 159. Accordingly, the transmission rod 154 is frictionally fixed to the cylinder 158 by a predetermined pressure.

When the piston 123 is moved downwardly relative to the slide 104 at the time of the overload safety operation during the press work, only the coupling rod 163 is moved downwardly with elastically compressing the coupling spring 164 synchronously with the downward movement of the piston 123 so as to actuate the microswitch 165 while the transmission rod 154 is kept fixed to the slide 104 through the friction engaging sleeve 160 and the cylinder 158. In this construction, since the transmission rod 154 is not moved interlockingly with the piston 123 at the overload safety operation, the counter 153 for the die-height indication is not affected by shocks.

Owing to the long period operation of the crank press, the ball joint 127 provided between the piston 123 and the connecting rod 124 is subject to abrasions so as to enlarge the fitting gap therebetween. But at the time of the die-height adjustment, since the piston 123 and the underside of the connecting rod 124 are abutted against each other automatically by the resilient force of the return spring 138 in the spring chamber 137 and the air spring, rattling movements between the piston 123 and the connecting rod 124 are prevented. Therefore, even though some abrasions are caused in the ball joint 127, it is unnecessary to put a sheet of shim for the gap adjustment into the slide 104 as well as to disassemble and assemble again the slide 104.

Further, when the die-set is mounted to the mechanical press, the pressure oil is discharged from the actuating oil chamber 136 for the height-adjustment by the operation of the pressure oil supply exhaust means 133 for the actuation of the extending and contracting mechanism so that the pre-load can be applied to the die-set by the spring force within the spring chamber 137. As a spring provided within the spring chamber 137, at least one of the return spring 138 and the air spring may be adopted. And instead of the air spring, a pressure oil may be supplied and exhausted for the spring chamber 137 in order to apply the strong pre-load thereto.

Figure 6:
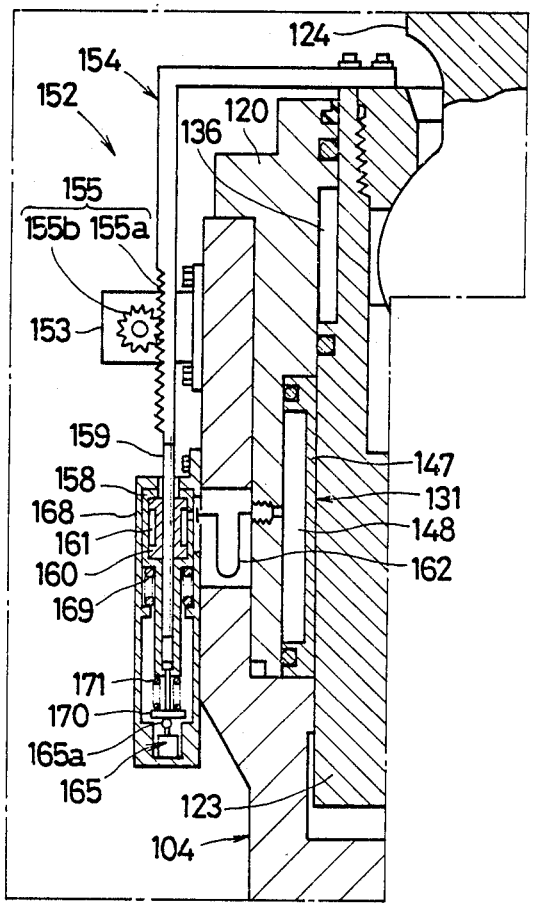

FIG. 6 shows a variant example of the second embodiment. The parts having the same functions as ones in the second embodiment are indicated by the same symbols respectively.

In this example, the die-height indicating means 152 is constructed as follows. Under the counter 153 for the dieheight indication, a support sleeve 168 is fixed to the slide 104. The cylinder 158 is passed through the upper half of the support sleeve 168. Within the cylinder 158, there are provided the actuating rod 159 and the friction engaging sleeve 160 as same as in the second embodiment. The cylinder 158 is pushed elastically upwardly by the return spring 169. On the other hand, a push rod 170 is passed through the lower half of the cylinder 158 vertically movably and is elastically pushed downwardly by an extension spring 171 so as to abut against the contact piece 165a of the microswitch 165.

And at the time of the overload safety operation, the piston 123 moves downwardly relative to the slide 104. When the transmission rod 154 is moved downwardly synchronously with the downward movement of the piston 123, the cylinder 158 is moved downwardly against the return spring 169 through the actuating rod 159 and the friction engaging sleeve 160 so that the push rod 170 actuates the microswitch 165.

According to the above-mentioned construction of the second embodiment, in addition to the advantages of the first embodiment, the following advantages are obtained.

(3) Since the extending and contracting mechanism 130 of the oil pressure actuation type only functions to extend and contract the driven member B″ relative to the driving member A″, the friction resistance thereof at the time of extending and contracting operation is small enough to enhance the transmission efficiency for the height-adjusting operation and also to lessen the actuating force. Therefore, the actuating cross sectional area of the actuation oil chamber 136 for the height-adjustment can be reduced as well as the supply/exhaust quantity of pressure oil can be lessened considerably.

Accordingly, the pressure oil supply/exhaust means 133 for the actuation of the extending and contracting mechanism can be made in a small size and in a small capability, and the energy consumption can be lessened owing to the high transmission efficiency of the extending and contracting mechanism 130 of the oil pressure actuation type. And in the case of the die-set mounting to the mechanical press, the spring force and/or the fluid pressure within the spring chamber 137 can be utilized effectively to apply the pre-load to the die-set because the transmission efficiency of the extending and contracting mechanism 130 is very high.

Figure 7:
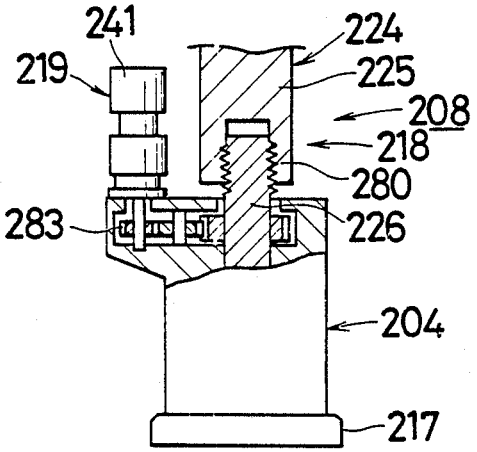
FIGS. 7 and 8 show a conventional embodiment.
Figure 8:
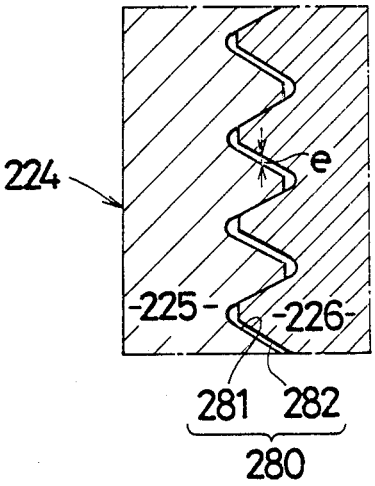

(4) In the prior art (refer to FIGS. 7 and 8), since there exists a large friction resistance against the actuation of the height-adjusting screw means 280, the height adjusting speed tends to get slower and it takes a longer time to carry out the die-height adjustment. However, according to the present invention, since the cross sectional area of the actuating oil chamber 136 for the die-height adjustment can be small as described in the item (3), the actuating speed of the driven member B″ gets higher with respect to the supply/exhaust quantity of the pressure oil so that the die-height adjustment can be completed in a short time.

(5) Since the pressure oil supply exhaust means 133 for the actuation of the extending and contracting mechanism in the operating device 119 for the adjustment of the extension and contraction can comprise a valve (or a booster pump) and supply/exhaust conduits, the construction thereof can get simplier in comparison with the height-adjusting electric motor and the gearing.

Further, since the pressure oil supply/exhaust means 133 can be simplified in its construction as mentioned above, it hardly suffers damages even though it is subject to shocks at the press work. As the result, the durability of the operating device 119 for the adjustment of the extension and contraction is enhanced.

(6) At the time of the die-height adjustment after the die-set mounting to the mechanical press, the friction securing force by the friction engaging sleeve 147 can be settled to a predetermined small value by the adjusting operation of the pressure oil supply control means 134 for the clamp actuation so that the slide 104 slips relative to the piston 123 owing to the descendant force of the mechanical press and then the die-height is adjusted automatically. Accordingly, it doesn't take a time and a labor so much to adjust the die-height.

We claim:

1. A die-height adjusting device for a mechanical press said press having a slide and a prime mover therefor and a slide actuator coupled between the slide and the prime mover, said device mounted at least in part within said slide and gearable to extend or contract said slide comprising:

means for extending and contracting said slide and clamp means carried by said slide; first actuator means coupled to said means for extending and contracting and second actuator means coupled to said clamp means, said means for extending and contracting including a driving member coupled to said first actuator and a driven member coupled to said driving member, said clamp means clamping said driven member to said driving member to prevent loose movement therebetween in response to actuation thereof by said second actuator.

2. The die-height adjusting device of claim 1, wherein the driving member comprises a piston, disposed within the slide and the driven member comprises the slide.

3. The die-height adjusting device of claim 1, wherein the driving member comprises the slide, and the driven member comprises a piston disposed within the slide.

4. The die-height adjusting device of claim 1, wherein a piston is vertically slidably mounted in the interior of the slide said piston being clamped to the slide by the clamp means, and the clamping force of the clamp means is nearly the same value as a full load of the mechanical press, and the piston is adapted to slide downwardly relative to the slide against the clamping force of the clamp means so as to operate as an overload safety device when an overload is applied to the slide.

5. The die-height adjusting device of claim 4, wherein a cylinder is mounted within the slide and a friction engaging sleeve is provided between the exterior peripheral surface of the piston and the interior peripheral surface of the cylinder, and the clamp means is an oil pressure type providing a clamp actuating oil chamber between the cylinder and the friction engaging sleeve so that the slide and the piston can be frictionally engaged with each other by the oil pressure within the clamp actuating oil chamber through the friction engaging sleeve.

6. The die-height adjusting device of claim 2 wherein the means for extending and contracting mechanism includes a height-adjusting screw threadably mounted within the piston which is adapted to be linearly movably relative to the slide, and the first actuating means comprises a height-adjusting electric motor and a gearing.

7. The die-height adjusting device of claim 6, wherein the heightadjusting electric motor is mounted on the slide.

8. The die-height adjusting device of claim 6, wherein the heightadjusting electric motor is mounted on the mechanical press.

9. The die-height adjusting device of claim 1, wherein the first actuator is the oil pressure actuating type and the clamp means is the oil pressure type first and second actuator means comprise a first pressure oil supply exhaust means for the actuation of the means for extending and contracting and a second pressure oil supply exhaust means for the clamp means actuation, the means for extending and contracting being adapted to be actuated to contract against a slide extension force and to extend with the slide extension force, the oil pressure type clamp being actuated by the pressure oil supply exhaust means for the clamp actuation, said means for extending and contracting including a spring chamber disposed within the slide and means within said chamber for providing at least part of the slide extension force and the driven member being of the oil pressure actuating type fixed to the driving member thereof by the oil pressure type clamp so as to prevent a relative loose movement therebetween in the extending and contracting direction when the oil pressure type clamp is actuated to the clamping position by the second pressure oil supply exhaust means.

10. The die-height adjusting device of claim 9, wherein the slide extension force means within the spring chamber comprises at least one of a return spring within the spring chamber and an air spring force of a compressed air introduced thereinto.

11. The die-height adjusting device of claim 9, wherein means for providing the slide extension force includes oil pressure introduced into the spring chamber.

12. The die-height adjusting device of claim 9, wherein there is provided a transmission rod between the driving member and the driven member to actuate a counter for die-height indication and is frictionally fixed and released relative to the slide by the second pressure oil supply exhaust means for the clamp actuation.

* * * * *